US012258823B2

(12) United States Patent
Saleh et al.

(10) Patent No.: US 12,258,823 B2
(45) Date of Patent: Mar. 25, 2025

(54) DRILLING FLUID TEMPERATURE OPTIMIZATION

(71) Applicant: Saudi Arabian Oil Company, Dhahran (SA)

(72) Inventors: Rami F. Saleh, Dhahran (SA); Mahmoud Adnan Alqurashi, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/324,725

(22) Filed: May 26, 2023

(65) Prior Publication Data

US 2024/0392638 A1 Nov. 28, 2024

(51) Int. Cl.
*E21B 21/06* (2006.01)

(52) U.S. Cl.
CPC ..... *E21B 21/06* (2013.01)

(58) Field of Classification Search
CPC ..... E21B 21/06
See application file for complete search history.

(56) References Cited

U.S. PATENT DOCUMENTS 3,815,673 A * 6/1974 Bruce ..... E21B 7/128 166/359
3,845,784 A * 11/1974 Sullivan ..... E21B 21/10 137/515
4,189,243 A 2/1980 Black
5,273,112 A * 12/1993 Schultz ..... E21B 34/16 166/250.07
2010/0155063 A1* 6/2010 Tibbitts ..... E21B 21/085 166/275
2014/0174830 A1 6/2014 Bingham et al.
2015/0126415 A1* 5/2015 Husein ..... C09K 8/502 507/140
2015/0330165 A1 11/2015 Thiessen

OTHER PUBLICATIONS

[No. Author Listed] [online], "Temperature change of a fluid flowing through a nozzle," Dec. 2020, retrieved on May 1, 2024, URL <https://www.youtube.com/watch?v=whc15ELu4Ig>, 2 pages [Video Submission].

(Continued)

*Primary Examiner* — Giovanna Wright
*Assistant Examiner* — Ronald R Runyan
(74) *Attorney, Agent, or Firm* — Fish & Richardson P.C.

(57) ABSTRACT

A drilling fluid temperature optimization system includes a receiving tank and one or more nozzle assemblies. Each nozzle assembly includes a housing enclosing an inner chamber fluidically connected to one or more nozzles. Each of the one or more nozzle assemblies is configured to receive within its respective inner chamber drilling fluid flowing from the wellbore. The system also includes an air compressor configured to inject compressed air into each inner chamber, forming a mixture of air entrained in drilling fluid flowing through the inner chamber to the one or more nozzles. The system is configured such that the receiving tank receives the mixture as it is expelled from the one or more nozzles.

20 Claims, 4 Drawing Sheets

(56) References Cited

OTHER PUBLICATIONS

Solidcontrolsystem.com [online], "Drilling Mud Cooler," available on or before May 10, 2023, via Internet Archive: Wayback Machine URL <https://web.archive.org/web/20230510004517/https://www.solidscontrolsystem.com/product-item/drilling-mud-chiller/>, retrieved on May 6, 2024, URL <https://www.solidscontrolsystem.com/product-item/drilling-mud-chiller/>, 5 pages.
Theweatherprediction.com [online], "Pressure and Temperature Relationship," available on or before Jun. 30, 2014, via Internet Archive: Wayback Machine URL <https://web.archive.org/web/20240222202254/https://www.theweatherprediction.com/habyhints2/688/>, retrieved on Feb. 22, 2024, 2 pages.
Yamada et al., "Study of Cooling System with Water Mist Sprayers: Fundamental Examination of Particle Size Distribution and Cooling Effects," Building Simulation, Sep. 2008, 9 pages.

* cited by examiner

DRILLING FLUID TEMPERATURE OPTIMIZATION

TECHNICAL FIELD

This disclosure relates to the production of oil, gas, or other resources from subterranean zones to the surface.

BACKGROUND

Hydrocarbons trapped in subsurface reservoirs can be raised to the surface of the Earth (that is, produced) through wellbores formed from the surface to the subsurface reservoirs. Wellbore drilling systems are used to drill wellbores through a subterranean zone (for example, a formation, a portion of a formation or multiple formations) to the subsurface reservoir. At a high level, the wellbore drilling system includes a drill bit connected to an end of a drill string. The drill string is rotated and weight is applied on the drill bit to drill through the subterranean zone. Wellbore drilling fluid (also known as drilling mud) is flowed in a downhole direction through the drill string. The drilling fluid exits the drill bit through ports defined in the drill bit and can be circulated in an uphole direction through an annulus defined by an outer surface of the drill string and an inner wall of the wellbore to the surface and then recirculated downhole after filtering and other treatment processes, in a closed (or partially closed) loop.

SUMMARY

Certain aspects of the subject matter herein can be implemented as a drilling fluid temperature optimization system for cooling drilling fluid circulating in a wellbore drilled by wellbore drilling system. The system includes a receiving tank and one or more nozzle assemblies. Each nozzle assembly includes a housing enclosing an inner chamber fluidically connected to one or more nozzles. Each of the one or more nozzle assemblies is configured to receive within its respective inner chamber drilling fluid flowing from the wellbore. The system also includes an air compressor configured to inject compressed air into each inner chamber, forming a mixture of air entrained in drilling fluid flowing through the inner chamber to the one or more nozzles. The system is configured such that the receiving tank receives the mixture as it is expelled from the one or more nozzles. The system further includes a pump configured to pump the drilling fluid in the mixture received in the receiving tank back into the wellbore.

An aspect combinable with any of the other aspects can include the following features. The nozzles can be configured to atomize the mixture as it exits the nozzles.

An aspect combinable with any of the other aspects can include the following features. The system can also include a check valve at an inlet of the one or more nozzle assemblies and configured to prevent a backflow of drilling fluid from the inner chambers.

An aspect combinable with any of the other aspects can include the following features. The one or more nozzle assemblies can be a first nozzle assembly set, and the system can further include a monitoring tank configured to receive the mixture from the receiving tank prior to the pump pumping the drilling fluid in the mixture back into the wellbore. The system can also include a second nozzle assembly set comprising one or more nozzle assemblies, each nozzle assembly of the second nozzle assembly set comprising a housing enclosing an inner chamber fluidically connected to one or more nozzles, wherein each of the nozzle assemblies is configured to receive within its respective inner chamber the mixture from the monitoring tank. The system can be configured to, in response to a determination that a temperature of the mixture in the monitoring tank is above a specified temperature, recirculate the mixture from the monitoring rank into the second nozzle set, inject compressed air into the mixture within each inner chamber of each nozzle assembly of the second nozzle assembly set, and expel the mixture from the one more nozzles of the second assembly back into the receiving tank, prior to flowing the mixture back into the wellbore.

An aspect combinable with any of the other aspects can include the following features. The system can further include an active tank from which the drilling fluid in the mixture is pumped by the pump back into the wellbore, the active tank configured to receive the mixture from the monitoring tank.

An aspect combinable with any of the other aspects can include the following features. The active tank can receive the mixture in response to a determination that the temperature of the mixture in the monitoring tank is below a specified temperature.

An aspect combinable with any of the other aspects can include the following features. The check valve can be a first check valve and the system can include a second check valve at an inlet of the one or more nozzle assemblies of the second nozzle assembly set. The second check valve can be configured to prevent a backflow of drilling fluid from the inner chambers of one or more nozzle assemblies of the second nozzle assembly set.

An aspect combinable with any of the other aspects can include the following features. The pump can be a first pump and the system can further include a second pump configured to pump the drilling fluid from the wellbore into the one or more nozzle assemblies.

An aspect combinable with any of the other aspects can include the following features. The system can further include a programmed logic control system including one or more processors and a non-transitory computer readable medium storing instructions executable by the one or more processors to perform operations. The operations can include receiving a measurement of the temperature of the mixture in the monitoring tank, and transmitting a control signal to a valve configured to selectively permit flow from the receiving tank to the second nozzle set. The determination that the temperature of the mixture in the monitoring tank is above a specified temperature can be by the programmed logic control system, and the recirculating the mixture from the monitoring tank to the second nozzle set can include the programmed logic control system transmitting the control signal to the valve in response to the determination.

An aspect combinable with any of the other aspects can include the following features. The valve can be a first valve and the system can further include an active tank from which the drilling fluid in the mixture is pumped by the pump back into the wellbore. The active tank can be configured to receive the mixture from the monitoring tank. The system can also include a second valve configured to selectively direct flow from the monitoring tank to the active tank. The operations can further include transmitting, by the programmed logic control system in response to a determination by the programmed logic control system that the temperature of the mixture in the monitoring tank is below a specified temperature, a control signal to a second valve to flow the mixture from the monitoring tank to the active tank.

Certain aspects of the subject matter herein can be implemented as a method. The method includes flowing, from a wellbore, drilling fluid into one or more nozzle assemblies of a drilling fluid temperature optimization system. Each nozzle assembly of the drilling fluid cooling system can include a housing enclosing an inner chamber fluidically connected to one or more nozzles. Each of the one or more nozzle assemblies is configured to receive within its respective inner chamber the drilling fluid flowing from the wellbore. The method further includes injecting, from an air compressor, compressed air into each inner chamber, thereby forming a mixture of air entrained in drilling fluid flowing through the inner chamber to the one or more nozzle, and expelling, from the one or more nozzles, the mixture into a receiving tank. The method further includes pumping, by a pump, the drilling fluid in the mixture received in the receiving tank back into the wellbore.

An aspect combinable with any of the other aspects can include the following features. The expelling from the nozzles can include atomizing the mixture as it exits the nozzles.

An aspect combinable with any of the other aspects can include the following features. The drilling fluid temperature optimization system can include a check valve at an inlet of the one or more nozzle assemblies and configured to prevent a backflow of drilling fluid from the inner chambers.

An aspect combinable with any of the other aspects can include the following features. The one or more nozzle assemblies can be first nozzle assembly set, and the drilling fluid cooling system can further include a monitoring tank configured to receive the mixture from the receiving tank prior to the pump pumping the drilling fluid in the mixture back into the wellbore. The system can further include a second nozzle assembly set comprising one or more nozzle assemblies, with each nozzle assembly of the second nozzle assembly set comprising a housing enclosing an inner chamber fluidically connected to one or more nozzles. Each of the nozzle assemblies is configured to receive within its respective inner chamber the mixture from the monitoring tank. The method can further include, in response to a determination that a temperature of the mixture in the monitoring tank is above a specified temperature, recirculating the mixture from the monitoring rank into the second nozzle set, injecting compressed air into the mixture within each inner chamber of each nozzle assembly of the second nozzle assembly set, and expelling the mixture from the one ore more nozzles of the second assembly back into the receiving tank, prior to flowing the mixture back into the wellbore.

An aspect combinable with any of the other aspects can include the following features. The method can further include flowing the mixture from the monitoring tank to an active tank from which the drilling fluid in the mixture is pumped by the pump back into the wellbore.

An aspect combinable with any of the other aspects can include the following features. The mixture can be flowed to the active tank in response to a determination that the temperature of the mixture in the monitoring tank is below a specified temperature.

An aspect combinable with any of the other aspects can include the following features. The check valve can be a first check valve and the system can include a second check valve at an inlet of the one or more nozzle assemblies of the second nozzle assembly set. The second check valve can be configured to prevent a backflow of drilling fluid from the inner chambers of one or more nozzle assemblies of the second nozzle assembly set.

An aspect combinable with any of the other aspects can include the following features. The pump can be a first pump and the flowing, from the wellbore, the drilling fluid into one or more nozzle assemblies can include pumping, with a second pump, the drilling fluid from the wellbore into the one or more nozzle assemblies.

An aspect combinable with any of the other aspects can include the following features. The drilling fluid temperature optimization system can further include a programmed logic control system including one or more processors and a non-transitory computer readable medium storing instructions executable by the one or more processors to perform operations. The determination that the temperature of the mixture in the monitoring tank is above a specified temperature can be by the programmed logic control system based on a temperature measurement received by the programmed logic control system. The recirculating the mixture from the monitoring tank to the second nozzle set can be by the programmed logic control system transmitting a control signal to a valve in response to the determination. The control signal actuating the valve can be such that the valve permits flow from the receiving tank to the second nozzle set.

An aspect combinable with any of the other aspects can include the following features. The valve can be a first valve and the system can further include an active tank from which the drilling fluid in the mixture is pumped by the pump back into the wellbore. The active tank can be configured to receive the mixture from the monitoring tank. The method can further include transmitting, by the programmed logic control system in response to a determination by the programmed logic control system that the temperature of the mixture in the monitoring tank is below a specified temperature, a control signal to a second valve to permit flow from the monitoring tank to the active tank.

DETAILED DESCRIPTION

The details of one or more implementations of the subject matter of this specification are set forth in this detailed description, the accompanying drawings, and the claims. Other features, aspects, and advantages of the subject matter will become apparent from this detailed description, the claims, and the accompanying drawings.

High temperatures within a wellbore can interfere with the functioning of downhole magnetometers, downhole electronics, downhole sensors, and other downhole components of a drill string or other wellbore or well site assembly. For example, long lateral wellbores in high temperature subsurface environments (with, for example, bottomhole temperatures greater than three-hundred degrees Fahrenheit) can present particular drilling challenges. Such circumstances can cause higher frequency of temperature-related measurement-while-drilling (MWD) and logging-while-drilling (LWD) failures and also strongly affect the performance of drilling fluids, cements, well casing and tubing, elastomers and seals in packers. It has also been established that, in long horizontal wells under certain operating well conditions, the bottom-hole circulation temperature can rise above the static bottom-hole temperature. Thus it can be desirable for a temperature of drilling fluid flowing into the wellbore be below a specified maximum temperature.

In accordance with embodiments of the present disclosure, a drilling fluid temperature optimization system is used to cool drilling fluid or other wellbore fluid after it comes out from the well through the flowline and before being recirculated downhole. In accordance with some embodiments, compressed air having a lower temperature than drilling fluid is injected from an air compressor into a nozzle assembly along with the wellbore fluid. The compressed air forms a mixture with the wellbore fluid, and the temperature of the wellbore fluid is reduced by heat exchange with the air in the mixture. The mixture is then expelled through one or more nozzles into a receiving tank. The reduction in pressure as the air/wellbore fluid mixture exits the nozzles results in a further reduction in the temperature of the mixture due to adiabatic cooling effects from the pressure drop. In some embodiments, fluid which has passed through an initial set of nozzles (but that has not yet cooled enough such that it is below the desired maximum temperature) can be recirculated such that it is mixed with air from a second air compressor and flowed back into the receiving tank via a second set of nozzles, resulting in a further drop in temperature do to heat exchange with the air from the second compressor and the drop in pressure as the mixture exits the second set of nozzles. If the wellbore fluid has reached the desired temperature, it can then be pumped back into the well.

Figure 1:
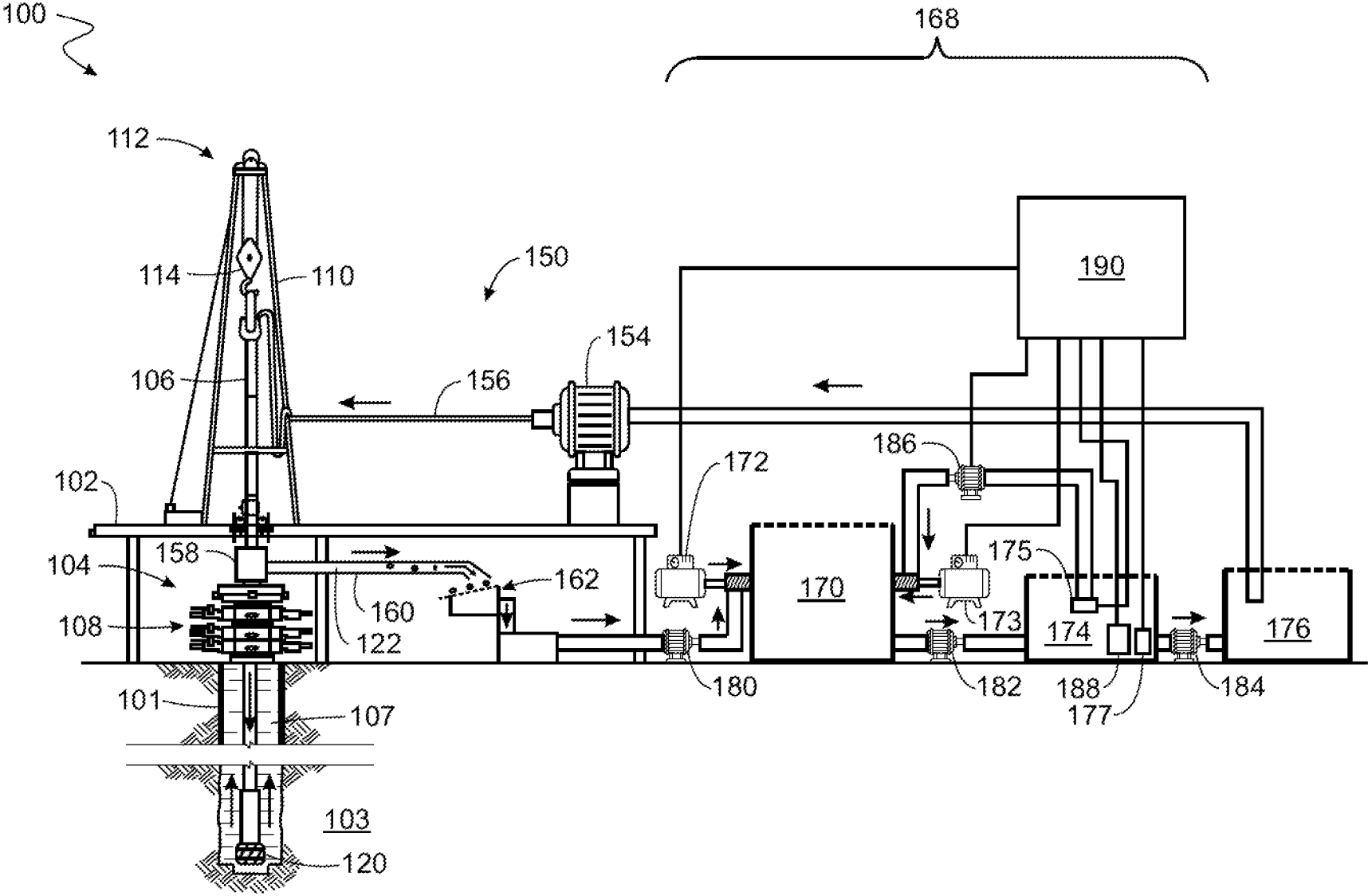
FIG. 1 is a schematic illustration of a well system with a drilling fluid temperature optimization system in accordance with an embodiment of the present disclosure.
Figure 2:
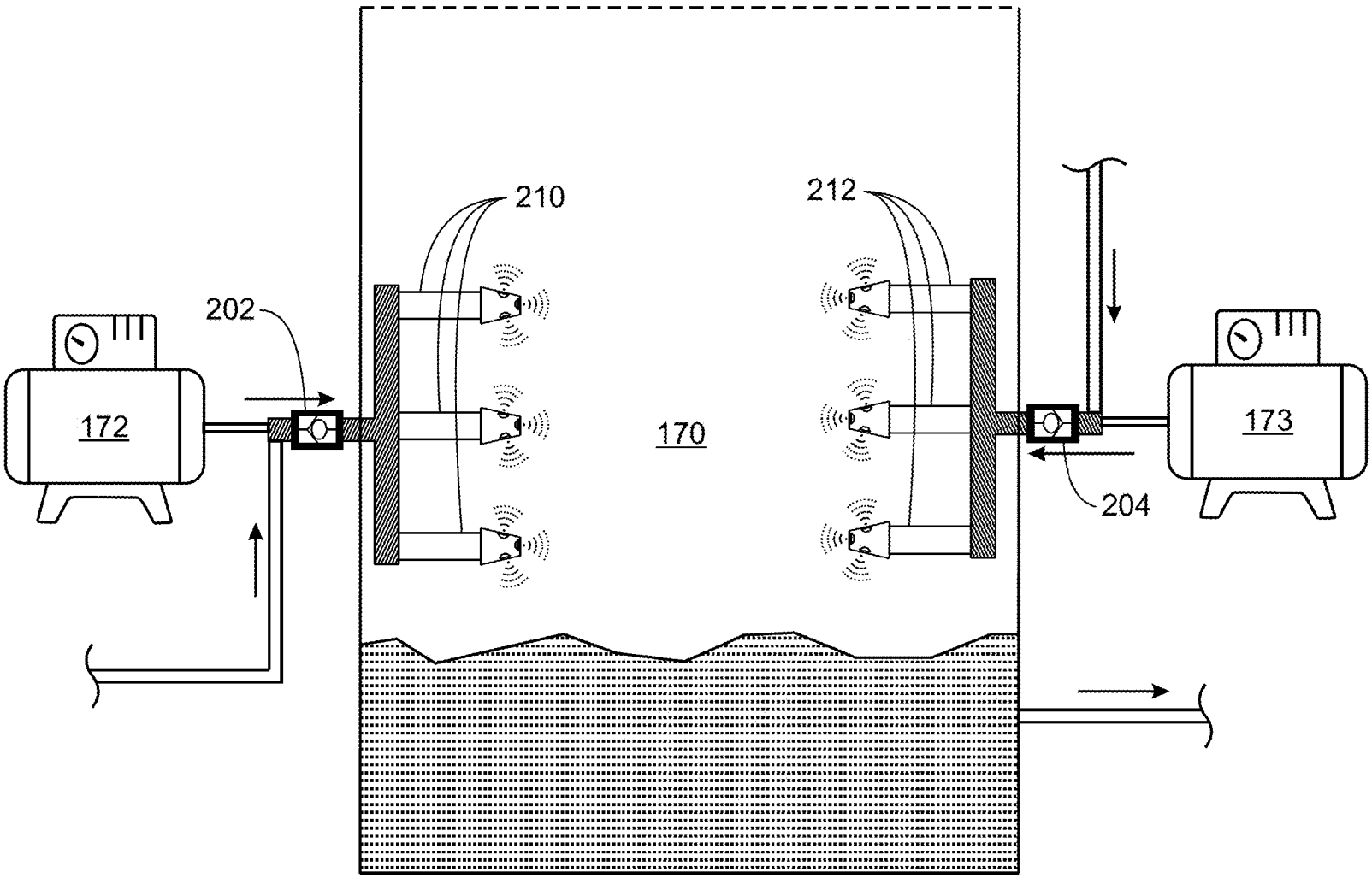
FIG. 2 is a schematic illustrations of components of a drilling fluid temperature optimization system in accordance with an embodiment of the present disclosure.
Figure 3:
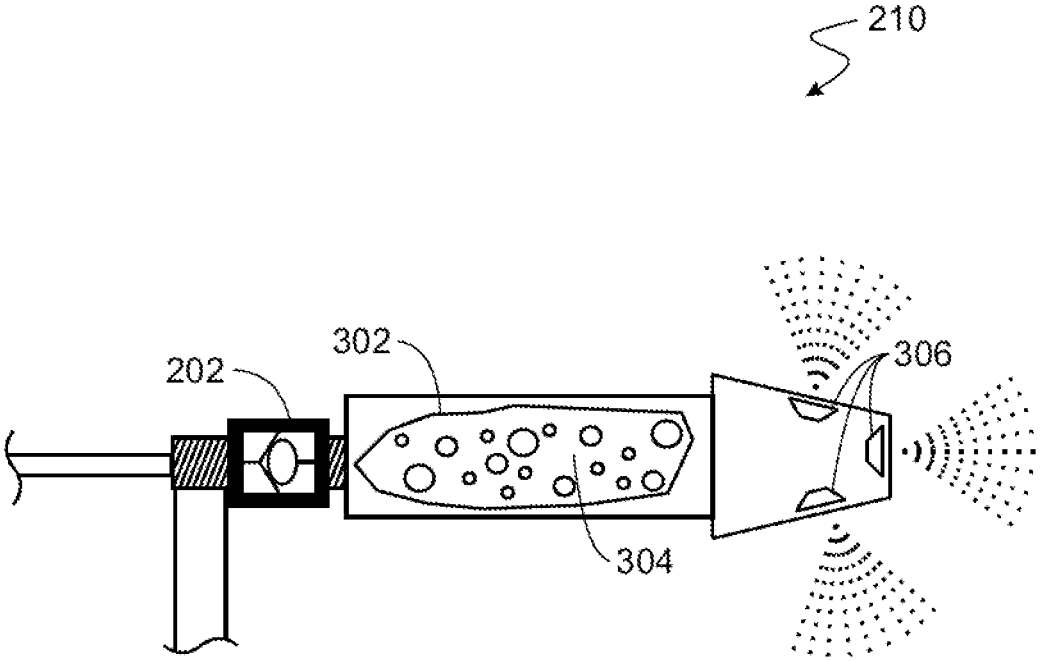
FIG. 3 is a schematic illustration of a nozzle assembly in accordance with an embodiment of the present disclosure.
Figure 4:
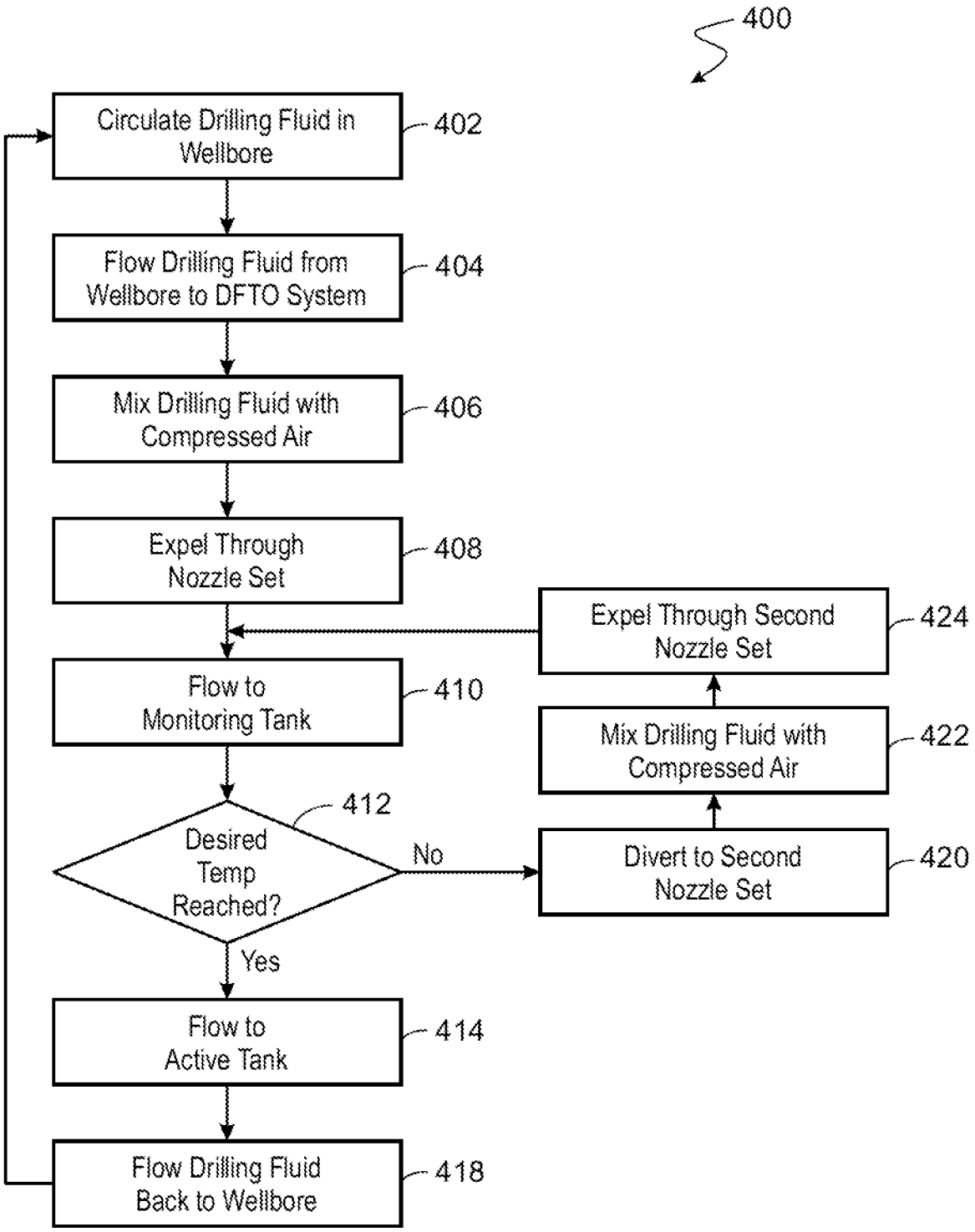
FIG. 4 is a process flow diagram of a method of cooling a drilling fluid circulating in a wellbore in accordance with an embodiment of the present disclosure.

FIG. 1 is a schematic diagram of a wellbore drilling system 100 configured to drill a wellbore 101, in accordance with an embodiment of the present disclosure. FIG. 2 is a schematic illustrations of components of the drilling fluid temperature optimization system of wellbore drilling system 100 of FIG. 1 in accordance with an embodiment of the present disclosure. FIG. 3 is a schematic illustration of a nozzle assembly of the drilling fluid temperature optimization system in accordance with an embodiment of the present disclosure. FIG. 4 is a process flow diagram of a method 400 of cooling drilling fluid in accordance with an embodiment of the present disclosure and will be described in reference to FIGS. 1, 2, and 3.

As shown in FIG. 1, wellbore 101 can extend from the surface through the Earth to one or more subterranean zones 103 of interest. The wellbore drilling system 100 includes a drill floor 102 positioned above the surface, a wellhead 104, and a drill string assembly 106 supported by the rig structure. Wellhead 104 supports casing or other wellbore components or equipment into the wellbore and includes various spools, valves, and assorted adapters that provide pressure control for the well. Atop wellhead assembly 104 is a blowout preventer 108 which acts to prevent wellbore blowouts caused by formation fluid entering the wellbore, displacing drilling fluid, and flowing to the surface at a pressure greater than atmospheric pressure. The blowout preventer 108 can close around (and in some instances, through) the drill string assembly 106 and seal off the space between the drill string and the wellbore wall.

The derrick 110 is a support framework mounted on the drill floor 102 and positioned over the wellbore to support the components of the drill string assembly 106 during drilling operations. A crown block 112 is positioned at top of the derrick 110 and connects to a travelling block 114 with a drilling line including a set of wire ropes or cables. The crown block 112 and the travelling block 114 support the drill string assembly 106 via a swivel, kelly, and/or top drive system.

In the wellbore drilling system 100 of FIG. 1, the drill string assembly 106 is made up of drill pipes with a bottomhole assembly 120 at its downhole end. Bottomhole assembly 120 can include a drill bit that rotates and penetrates through rock formations below the surface under the combined effect of axial load and rotation of the drill string assembly 106. Bottomhole assembly 120 can further include collars, directional drilling (MWD/LWD) instrumentation, and various electrical, electronic, or mechanical components for operating and/or controlling the drill bit.

Wellbore drilling system 100 further includes a drilling fluid 122 (sometimes referred to as drilling mud) which can serve to control formation pressures, remove cuttings from the wellbore, seal permeable formations encountered while drilling, cool and lubricating the drill bit and other components of bottomhole assembly 120, transmit hydraulic energy to downhole tools and the drill bit, and maintain wellbore stability and well control. During a drilling operation of the well, and per step 402 of FIG. 4, circulation system 150 circulates drilling fluid 122 to the drill string assembly 106, receives and filters used drilling fluid from the wellbore, and returns clean drilling fluid to the drill string assembly 106. Specifically, circulation system 150 includes a mud pump 154 that fluidly connects to and provides drilling fluid from mud pit 152 to drill string assembly 106 via the kelly hose 156. The drilling fluid flows through the drill string assembly 106, flows out the drill bit in bottomhole assembly 120 and back up the annulns 107. Annulus 107 is the space between the drill string assembly 106 and wellbore 101 or formation or casing disposed within wellbore 101. The drilling fluid 122 returns to the surface in the annulus 107 with rock cuttings and flows out bell nipple 158 to the flow-out line 160. From flow-out line 160, the fluid passes through a shale shaker 162 and its associated components. Shale shaker 162 can include a mesh-like surface to separate the rock cuttings and other debris from the drilling fluid 122. In the illustrated embodiment, per step 404 of FIG. 4, drilling fluid flowing from shale shaker 162 can be pumped by pump 180 into drilling fluid temperature optimization (DFTO) system 168 which, as described in further detail below, can be configured to reduce the temperature of the drilling fluid.

In the illustrated embodiment, DFTO system 168 includes a receiving tank 170 which (as described below in reference to FIG. 2) includes one or more nozzle assemblies, each configured to receive within its respective inner chamber drilling fluid 122 flowing from wellbore 101. DFTO system 168 also includes air compressors 172 and 173. As shown in FIG. 2, per step 406 of FIG. 4, compressed air from air compressor 172 having a lower temperature than drilling fluid 122 is injected into drilling fluid 122 to form a gas/liquid mixture. At step 408, the mixture is then expelled through nozzles of one or more nozzle assemblies 210 into receiving tank 170, which is open to atmospheric pressure. Check valve 202 prevents backflow of the mixture. The temperature of the drilling fluid 122 is reduced by heat exchange with the air in the mixture, and the reduction in pressure as the air/wellbore fluid mixture exits the nozzles results in a further reduction in the temperature of the mixture due to adiabatic cooling effects from the pressure drop.

Per step 410, the fluid mixture from receiving tank 170 can be pumped into monitoring tank 174 by pump 182. In the illustrated embodiment, DFTO system 168 further includes sensors 188 (which can include temperature sensors) configured to measure temperature and/or other parameters regarding fluid in monitoring tank 174. The system further includes control valve 175 configured to selectively permit flow from receiving tank 170 to a second nozzle set (described below) and control valve 177 configured to selectively permit flow monitoring tank 174 to active tank 176. The system also includes programmed logic control (PLC) system 190 which can include one or more processors and a non-transitory computer readable medium storing instructions executable by the one or more processors to perform operations. The operations can include receiving temperature and other measurements from sensors 188, comparing the temperature measurements to specified minimum or maximum temperatures, and transmitting control signals to compressors 172 and 173 and to control valves 175 and 177, in real time (or other than in real time) in response to such measurements.

At step 412 of FIG. 4, if PLC 190 determines that the mixture in monitoring tank 174 has cooled to the desired specified temperature (based on temperature measurements received by PLC 190 from sensors 188), the method proceeds to step 414 in which PLC 190 actuates control valve 177 and pump 184 to direct and pump the mixture to active tank 176. From active tank 184 the fluid can at step 416 be pumped by pump 154 back into drill string assembly 106 by mud pump 154, returning to step 402 and thus completing the circulation loop. Because receiving tank 170, monitoring tank 174, and/or active tank 176 are open to atmospheric pressure, the air entrained in the fluid mixture will be (or will substantially be) released (or effervesce or otherwise escape) from the drilling fluid prior to the being pumped back into the well.

In the illustrated embodiment, nozzle assemblies 210 are a first set of nozzle assemblies and DFTO system 168 further includes a second compressor 173 and a second nozzle assembly set 212. If at step 412 of FIG. 4 PLC 190 determines that the mixture in monitoring tank 174 has not cooled to the desired temperature, then the method proceeds to step 420 in which PLC 190 actuates control valve 175 and pump 186 to direct and pump the mixture to the second set of nozzle assembly set 212, and actuates compressor 173 pump additional air into the mixture such that (at step 424) is expelled through the second set of nozzles 212 resulting in additional cooling, with backflow prevented by check valve 204. Such recirculation can continue until the fluid has cooled to the desired temperature. In the illustrate embodiment, three nozzle assemblies 210 and three nozzle assemblies 212 are shown; however, other embodiments can include a greater or lesser number of nozzle assemblies as suitable for the type of drilling fluid, desired temperature reduction, nozzle configuration, and other factors.

FIG. 3 is a schematic illustration showing nozzle assembly 210 in greater detail in accordance with an embodiment of the present disclosure. Nozzle assembly 210 in the illustrated embodiment includes a housing 302 enclosing an inner chamber 304 in which the compressed air mixes with the drilling fluid prior to expulsion through one or more nozzles 306. In some embodiments, nozzles 306 are configured to atomize the mixture (i.e., to transform the mixture into a fine spray of small, individual droplets). Such atomization can further contribute to the cooling effect from contact of the fluid with air from the reduction in pressure. In some embodiments, nozzle assembly 210 can include three more 0.25" to 2.5" nozzles, for example of a suitable type available from Bete Nozzles of Greenfield, Massachusetts. Nozzle assembly 212 can in some embodiments have the same or similar structure and function as nozzle assembly 210.

While the illustrated embodiment is a drilling system circulating a drilling fluid that is cooled by the cooling system of the present disclosure, it will be understood that the apparatus, system, and method of the present disclosure is not limited to drilling systems or to drilling fluid but can be applied to other well systems (such as completed production wells) and to cooling other fluids other than drilling fluid that are flowed into or circulated through wells, such as stimulation fluids or lost circulation pills.

The term "uphole" as used herein means in the direction along a drill string, tubing, or the wellbore from its distal end towards the surface, and "downhole" as used herein means the direction along the drill string, tubing, or the wellbore from the surface towards its distal end. A downhole location means a location along the drill string, tubing, or wellbore downhole of the surface. "Approximately" or "substantially" as used herein means a deviation or allowance of up to 10 percent (%) and any variation from a mentioned value is within the tolerance limits of any machinery used to manufacture the part. Likewise, "about" can also allow for a degree of variability in a value or range, for example, within 10%, within 5%, or within 1% of a stated value or of a stated limit of a range.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

What is claimed is:

1. A drilling fluid temperature optimization system for cooling drilling fluid circulating in a wellbore drilled by wellbore drilling system, the system comprising:

a receiving tank;

one or more nozzle assemblies at least partially disposed in the receiving tank, each nozzle assembly comprising a housing enclosing an inner chamber fluidically connected to one or more nozzles, wherein each of the one or more nozzle assemblies is configured to receive within its respective inner chamber drilling fluid flowing from a wellhead of the wellbore;

an air compressor configured to inject compressed air into each inner chamber, thereby forming a mixture of air entrained in drilling fluid flowing through the inner chamber to the one or more nozzles, wherein the system is configured such that the receiving tank receives the mixture as it is expelled from the one or more nozzles; and a pump configured to pump the drilling fluid in the mixture received in the receiving tank back into the wellbore through the wellhead.

2. The system of claim 1, wherein the nozzles are configured to atomize the mixture as it exits the nozzles.

3. The system of claim 1, further comprising a check valve at an inlet of the one or more nozzle assemblies and configured to prevent a backflow of drilling fluid from the inner chambers.

4. The system of claim 1, wherein:

the one or more nozzle assemblies comprises a first nozzle assembly set;

the system further comprises:

a monitoring tank configured to receive the mixture from the receiving tank prior to the pump pumping the drilling fluid in the mixture back into the wellbore; and a second nozzle assembly set comprising one or more nozzle assemblies, each nozzle assembly of the second nozzle assembly set comprising a housing enclosing an inner chamber fluidically connected to one or more nozzles, wherein each of the nozzle assemblies is configured to receive within its respective inner chamber the mixture from the monitoring tank; and the system is configured to, in response to a determination that a temperature of the mixture in the monitoring tank is above a specified temperature, recirculate the mixture from the monitoring rank into the second nozzle set, inject compressed air into the mixture within each inner chamber of each nozzle assembly of the second nozzle assembly set, and expel the mixture from the one more nozzles of the second assembly back into the receiving tank, prior to flowing the mixture back into the wellbore.

5. The system of claim 4, wherein the system further comprises an active tank from which the drilling fluid in the mixture is pumped by the pump back into the wellbore, the active tank configured to receive the mixture from the monitoring tank.

6. The system of claim 5, wherein the active tank receives the mixture in response to a determination that the temperature of the mixture in the monitoring tank is below a specified temperature.

7. The system of claim 4, wherein the check valve is a first check valve and the system comprises a second check valve at an inlet of the one or more nozzle assemblies of the second nozzle assembly set, the second check valve configured to prevent a backflow of drilling fluid from the inner chambers of one or more nozzle assemblies of the second nozzle assembly set.

8. The system of claim 4, further comprising a programmed logic control system, the programmed logic control system comprising one or more processors and a non-transitory computer readable medium storing instructions executable by the one or more processors to perform operations comprising:

receiving a measurement of the temperature of the mixture in the monitoring tank; and transmitting a control signal to a valve configured to selectively permit flow from the receiving tank to the second nozzle set;

and wherein:

the determination that the temperature of the mixture in the monitoring tank is above a specified temperature is by the programmed logic control system;

and the recirculating the mixture from the monitoring tank to the second nozzle set comprises the programmed logic control system transmitting the control signal to the valve in response to the determination.

9. The system of claim 8, wherein the valve is a first valve and wherein:

the system further comprises:

an active tank from which the drilling fluid in the mixture is pumped by the pump back into the wellbore, the active tank configured to receive the mixture from the monitoring tank; and a second valve configured to selectively direct flow from the monitoring tank to the active tank; and the operations further comprise transmitting, by the programmed logic control system in response to a determination by the programmed logic control system that the temperature of the mixture in the monitoring tank is below a specified temperature, a control signal to a second valve to flow the mixture from the monitoring tank to the active tank.

10. The system of claim 1, wherein the pump comprises a first pump and wherein the system further comprises a second pump configured to pump the drilling fluid from the wellbore into the one or more nozzle assemblies.

11. A method comprising:

flowing, from a wellhead of a wellbore, drilling fluid into one or more nozzle assemblies of a drilling fluid temperature optimization system, the nozzle assemblies at least partially disposed in a receiving tank and each nozzle assembly of the drilling fluid temperature optimization system comprising a housing enclosing an inner chamber fluidically connected to one or more nozzles, wherein each of the one or more nozzle assemblies is configured to receive within its respective inner chamber the drilling fluid flowing from the wellbore;

injecting, from an air compressor, compressed air into each inner chamber, thereby forming a mixture of air entrained in drilling fluid flowing through the inner chamber to the one or more nozzle;

expelling, from the one or more nozzles, the mixture into the receiving tank;

pumping, by a pump, the drilling fluid in the mixture received in the receiving tank back into the wellbore through the wellhead.

12. The method of claim 11, wherein the expelling from the nozzles comprises atomizing the mixture as it exits the nozzles.

13. The method of claim 11, wherein the drilling fluid temperature optimization system further comprising a check valve at an inlet of the one or more nozzle assemblies and configured to prevent a backflow of drilling fluid from the inner chambers.

14. The method of claim 11, wherein:

the one or more nozzle assemblies comprises a first nozzle assembly set;

the drilling fluid cooling system further comprises:

a monitoring tank configured to receive the mixture from the receiving tank prior to the pump pumping the drilling fluid in the mixture back into the wellbore; and a second nozzle assembly set comprising one or more nozzle assemblies, each nozzle assembly of the second nozzle assembly set comprising a housing enclosing an inner chamber fluidically connected to one or more nozzles, wherein each of the nozzle assemblies is configured to receive within its respective inner chamber the mixture from the monitoring tank; and wherein the method further comprises, in response to a determination that a temperature of the mixture in the monitoring tank is above a specified temperature:

recirculating the mixture from the monitoring rank into the second nozzle set;

injecting compressed air into the mixture within each inner chamber of each nozzle assembly of the second nozzle assembly set; and expelling the mixture from the one or more nozzles of the second assembly back into the receiving tank, prior to flowing the mixture back into the wellbore.

15. The method of claim 14, wherein the method further comprises flowing the mixture from the monitoring tank to an active tank from which the drilling fluid in the mixture is pumped by the pump back into the wellbore.

16. The method of claim 15, wherein the mixture is flowed to the active tank in response to a determination that the temperature of the mixture in the monitoring tank is below a specified temperature.

17. The method of claim 14, wherein the check valve is a first check valve and the system comprises a second check valve at an inlet of the one or more nozzle assemblies of the second nozzle assembly set, the second check valve configured to prevent a backflow of drilling fluid from the inner chambers of one or more nozzle assemblies of the second nozzle assembly set.

18. The method of claim 14, wherein:

the drilling fluid temperature optimization system further comprises a programmed logic control system, the programmed logic control system comprising one or more processors and a non-transitory computer readable medium storing instructions executable by the one or more processors to perform operations;

the determining that the temperature of the mixture in the monitoring tank is above a specified temperature is by the programmed logic control system based on a temperature measurement received by the programmed logic control system; and the recirculating the mixture from the monitoring tank to the second nozzle set is by the programmed logic control system transmitting a control signal to a valve in response to the determination, wherein the control signal actuates the valve such that the valve permits flow from the receiving tank to the second nozzle set.

19. The method of claim 18, wherein:

the valve is a first valve;

the system further comprises an active tank from which the drilling fluid in the mixture is pumped by the pump back into the wellbore, the active tank configured to receive the mixture from the monitoring tank; and the method further comprises transmitting, by the programmed logic control system in response to a determination by the programmed logic control system that the temperature of the mixture in the monitoring tank is below a specified temperature, a control signal to a second valve to permit flow from the monitoring tank to the active tank.

20. The method of claim 11, wherein the pump comprises a first pump and wherein the flowing, from the wellbore, the drilling fluid into one or more nozzle assemblies comprises pumping, with a second pump, the drilling fluid from the wellbore into the one or more nozzle assemblies.

* * * * *